US009222713B1

(12) United States Patent
Jarmer

(10) Patent No.: US 9,222,713 B1
(45) Date of Patent: Dec. 29, 2015

(54) ICE MACHINE WITH FALSE BOTTOM

(71) Applicant: Curtis D. Jarmer, Gresham, OR (US)

(72) Inventor: Curtis D. Jarmer, Gresham, OR (US)

( * ) Notice: Subject to any disclaimer, the term of this patent is extended or adjusted under 35 U.S.C. 154(b) by 334 days.

(21) Appl. No.: 13/964,044

(22) Filed: Aug. 10, 2013

(51) Int. Cl.
*F25D 3/02* (2006.01)
*F25D 3/04* (2006.01)

(52) U.S. Cl.
CPC ..... *F25D 3/04* (2013.01)

(58) Field of Classification Search
CPC ..... F25D 3/08; F25D 2331/80; F25D 3/06; F25D 3/02
USPC ..... 62/371, 389, 457.1, 457.2, 457.5, 62/457.7, 462
See application file for complete search history.

(56) References Cited

U.S. PATENT DOCUMENTS

| | | | | | |
|---|---|---|---|---|---|
| 700,721 | A * | 5/1902 | Ames | A47B 88/0014 | 217/130 |
| 4,706,466 | A | 11/1987 | Yingst et al. | | |
| 4,848,102 | A | 7/1989 | Stanfill | | |
| 5,245,841 | A | 9/1993 | Paul et al. | | |
| 5,671,611 | A * | 9/1997 | Quigley | F25D 3/08 | 62/371 |
| D407,421 | S | 3/1999 | Strandell et al. | | |
| 6,782,711 | B2 | 8/2004 | Abfalter | | |
| 7,458,481 | B2 * | 12/2008 | Yuen | A45C 11/20 | 220/737 |
| 7,950,249 | B1 * | 5/2011 | White | F25D 3/08 | 62/457.1 |
| 2011/0023521 | A1 | 2/2011 | Kondo et al. | | |

* cited by examiner

*Primary Examiner* — Melvin Jones

(57) ABSTRACT

The multi-level storage assembly for storing clean ice discretely from contaminated ice includes a housing that may contain ice. A panel is movably coupled to the housing. The panel defines an upper portion and a lower portion of an interior of the housing. The upper portion stores the clean ice. The lower portion stores the contaminated ice. A drain is coupled to the housing.

6 Claims, 4 Drawing Sheets

ICE MACHINE WITH FALSE BOTTOM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of ice machines, more specifically, an ice machine that has a false bottom to enable contaminated ice to be removed without further exposure to non-contaminated ice.

SUMMARY OF THE INVENTION

An embodiment of the disclosure meets the needs presented above by generally comprising a housing that may contain ice. A panel is movably coupled to the housing. The panel defines an upper portion and a lower portion of an interior of the housing. The upper portion stores the clean ice. The lower portion stores the contaminated ice. A drain is coupled to the housing.

These together with additional objects, features and advantages of the ice machine with false bottom will be readily apparent to those of ordinary skill in the art upon reading the nonetheless illustrative, embodiments of the ice machine with false bottom when taken in conjunction with the accompanying drawings.

In this respect, before explaining the current embodiments of the ice machine with false bottom in detail, it is to be understood that the ice machine with false bottom is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ice machine with false bottom.

It is therefore important that the claims be regarded as including such equivalent construction insofar as they do not depart from the spirit and scope of the ice machine with false bottom. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
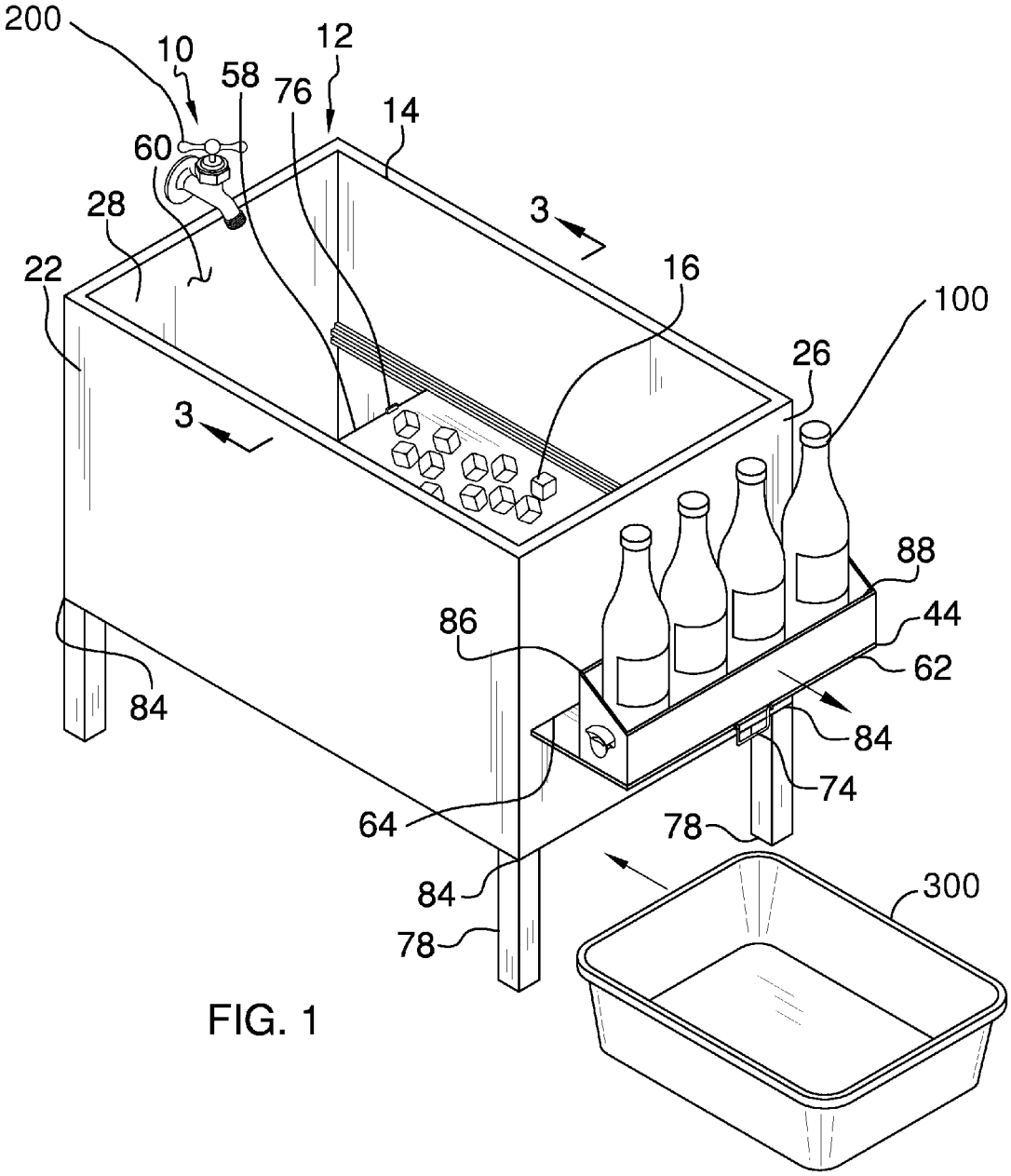
FIG. 1 is a top perspective view of a multi-level storage assembly according to an embodiment of the disclosure.
Figure 2:
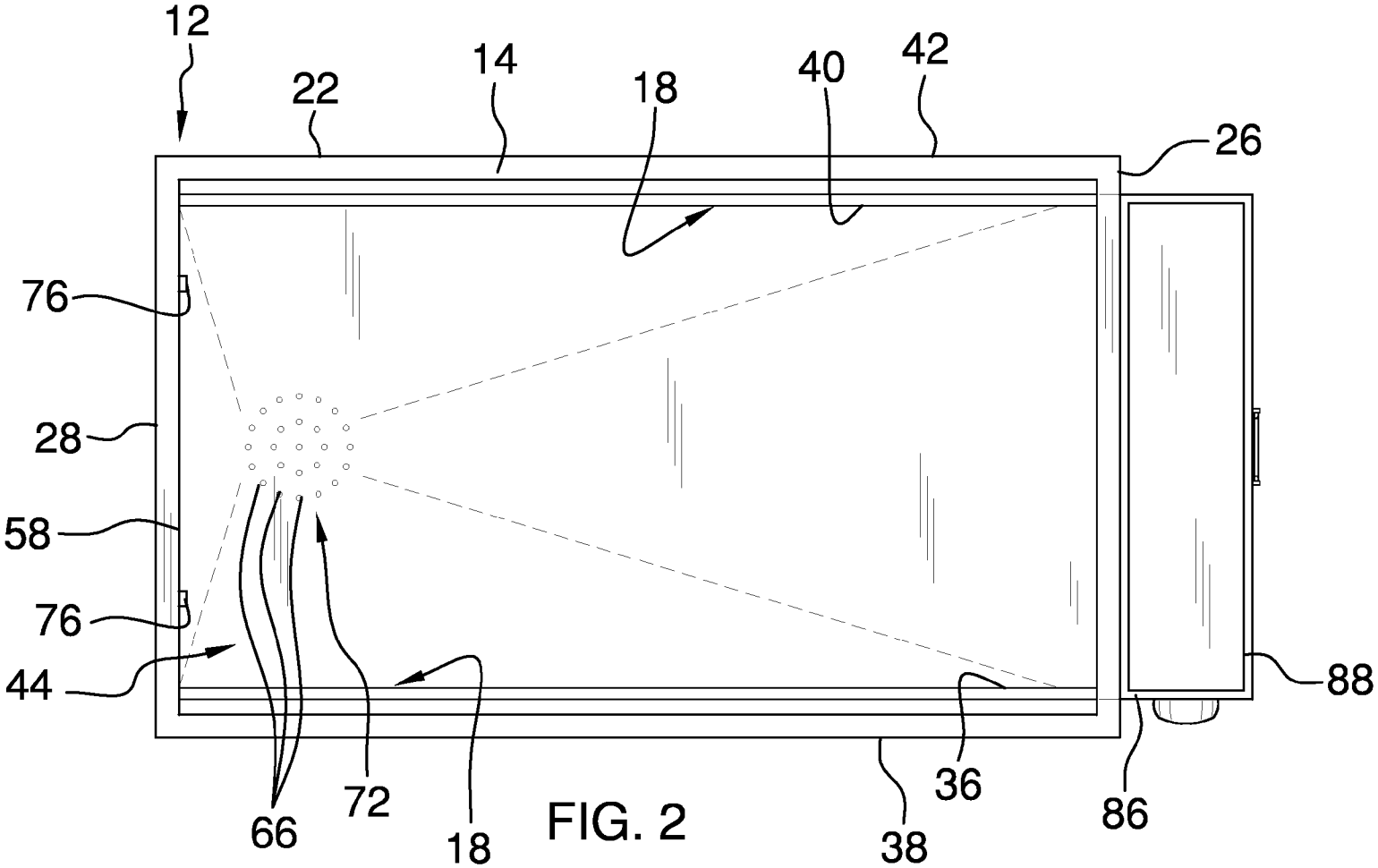
FIG. 2 is a top view of an embodiment of the disclosure.
Figure 3:
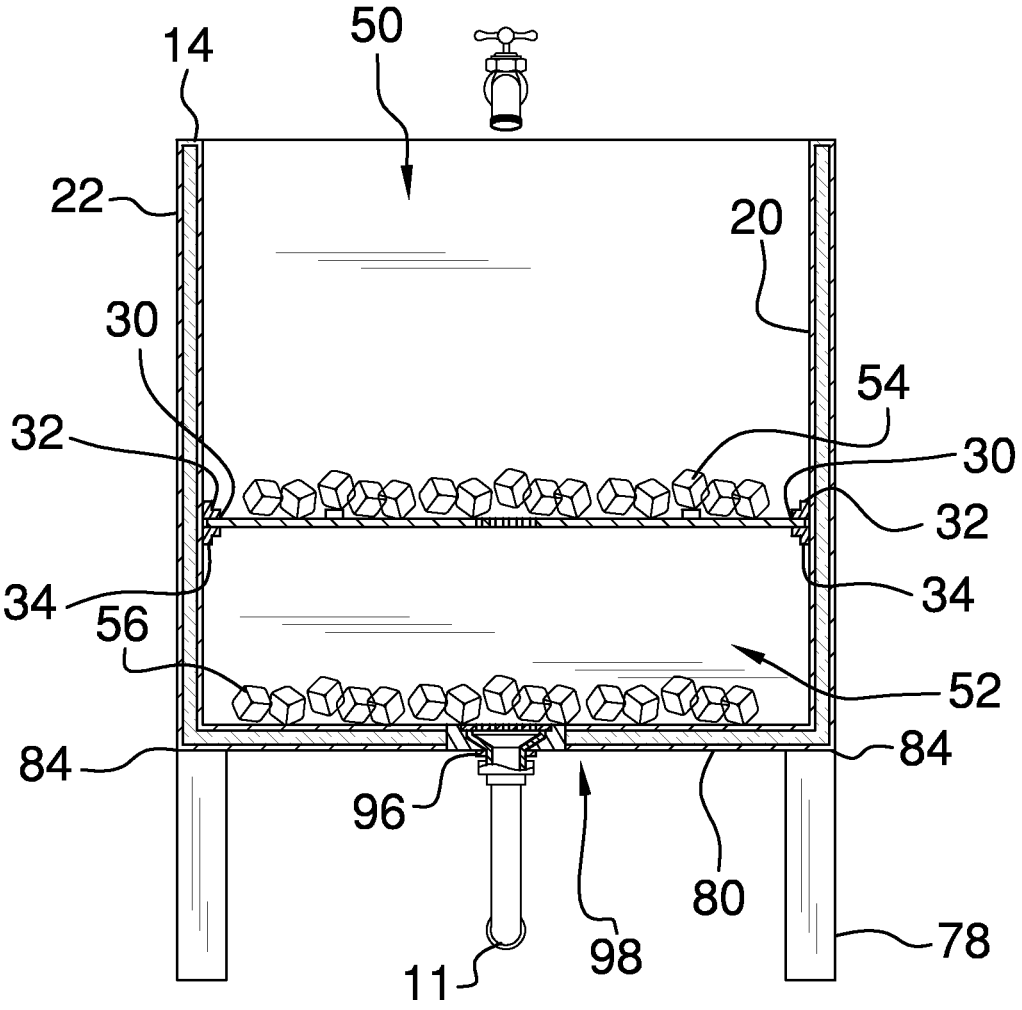
FIG. 3 is a cross sectional view taken along line 3-3 of FIG. 1 of an embodiment of the disclosure.
Figure 4:
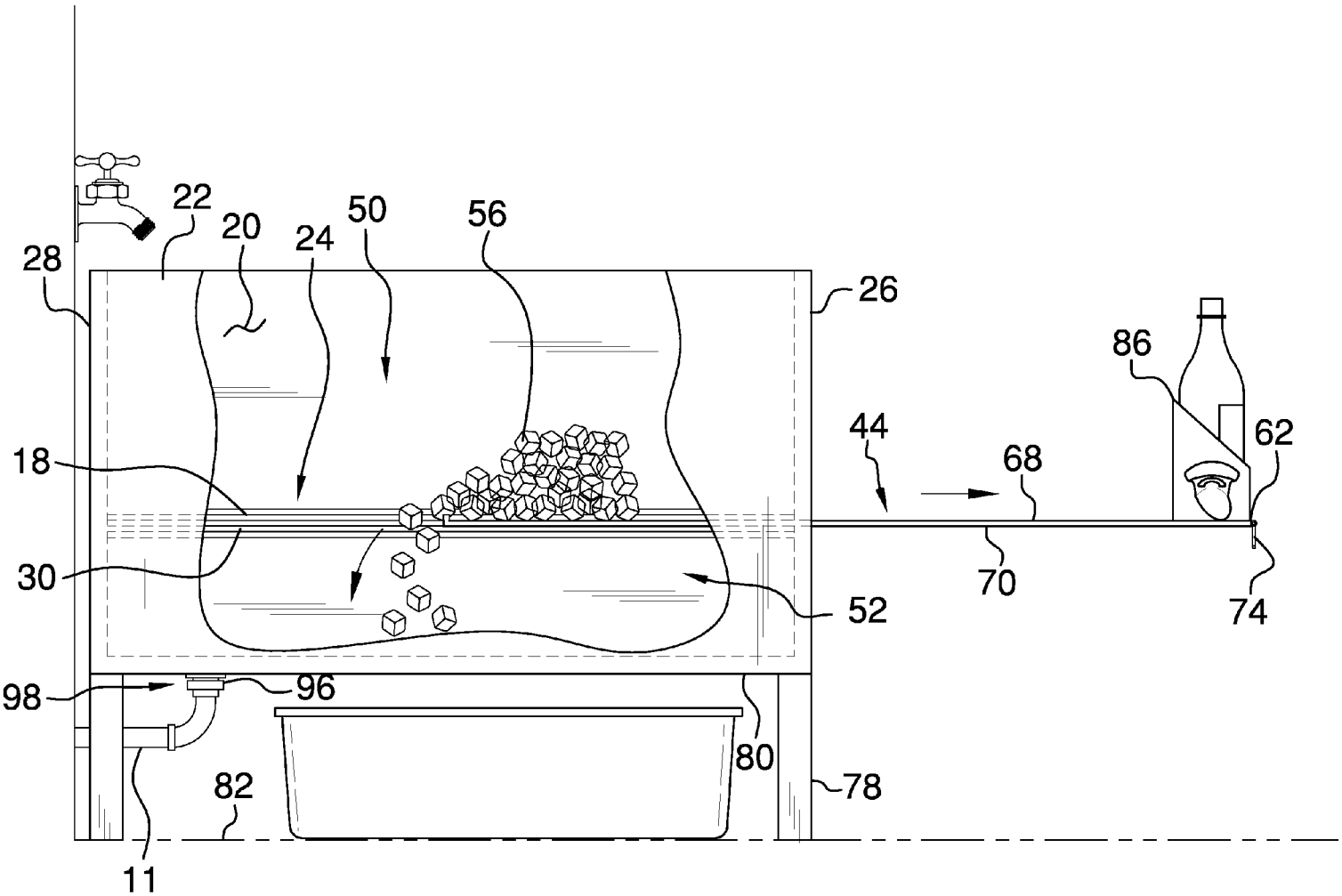
FIG. 4 is a right side cut-away view of an embodiment of the disclosure.

As best illustrated in FIGS. 1 through 4, the multi-level storage assembly 10 (hereinafter assembly) generally comprises a housing 12 that has an open top side 14 to access an interior of the housing 12. The housing 12 may contain ice 16. Further, the housing 12 may have a height between 90 cm and 100 cm, a width between 60 cm and 76 cm and a length between 90 cm and 100 cm. Lastly, the housing 12 may be comprised of a rigid and fluid impermeable material such as stainless steel or other similar material.

A track 18 is coupled to an inside surface 20 of an outer wall 22 of the housing 12 proximate a center 24 of the outer wall 22 of the housing 12. The track 18 extends between a front side 26 and a rear side 28 of the outer wall 22 of the housing 12. Additionally, a groove 30 extends laterally along the track 18. The groove 30 divides the track 18 into an upper portion of the track 32 and a lower portion of the track 34. Moreover, the track 18 is one of a pair of tracks 18. A first one of the tracks 36 is coupled to a first lateral side 38 of the outer wall 22 of the housing 12. Continuing, a second one of the tracks 40 is coupled to a second lateral side 42 of the outer wall 22 of the housing 12.

A panel 44 is provided. A first lateral edge 46 and a second lateral edge 48 of the panel 44 engages an associated one of the first 36 and second 40 tracks. Each of the first 46 and second 48 lateral edges of the panel 44 is positioned within the groove 30 in the associated one of the first 36 and second 40 tracks. Continuing, the panel 44 is slidably coupled to the housing 12 so the panel 44 defines an upper portion 50 and a lower portion 52 of the interior of the housing 12. The upper portion 50 of the housing 12 stores clean ice 54. Moreover, the lower portion 52 of the housing 12 stores contaminated ice 56.

The panel 44 is positionable in a stored position so a rear edge 58 of the panel 44 abuts an inside surface 60 of the rear side 28 of the outer wall 22 of the housing 12. Moreover, the panel 44 supports the ice 16 in the upper portion 50 of the housing 12 when the panel 44 is in the stored position. The panel 44 is positionable in an extended position so the rear edge 58 of the panel 44 is spaced apart from the inside surface 60 of the rear side 28 of the outer wall 22 of the housing 12. Additionally, a front edge 62 of the panel 44 extends outwardly from a panel slot 64 in the front side 26 of the outer wall 22 of the housing 12. The panel 44 releases the ice 16 into the lower portion 52 of the housing 12 when the panel 44 is in the extended position.

A plurality of drain apertures 66 extends through a top side 68 and a bottom side 70 of the panel 44 proximate a rear 72 of the panel 44. Additionally, a handle 74 is movably coupled to the front edge 62 of the panel 44 to be gripped. A pair of stops 76 is coupled to the rear edge 58 of the panel 44. Each of the stops 76 is positioned proximate an associated one of the first 46 and second 48 lateral edges of the panel 44. Continuing, the pair of stops 76 abuts the inside surface 60 of the rear side 28 of the outer wall 22 of the housing 12 when the panel 44 is in the stored position.

A leg 78 is coupled to and extends downwardly from a bottom side 80 of the outer wall 22 of the housing 12. The leg 78 supports the housing 12 above a support surface 82. Moreover, the support surface 82 may be a floor. The leg 78 is one of a plurality of the legs 78. Each of the plurality of legs 78 is positioned proximate an associated one of four corners 84 of the bottom side 80 of the outer wall 22 of the housing 12.

A bottle holder 86 is coupled to the panel 44. More specifically, the bottle holder 86 is a fixture to the top side 68 of the panel 44. Moreover, the bottle holder 86 is affixed to the front edge 62 of the panel 44. The bottle holder 86 has a front edge 88 that corresponds with the front edge 62 of the panel 44. The bottle holder 86 may have a depth between 10 cm and 15 cm. Continuing, the bottle holder 86 extends between the first lateral side 38 and the second lateral side 40 of the outer wall 22 of the housing 12. The bottle holder 86 is an elongated member that is open from above such that a plurality of bottles 100 is to be inserted and removed as needed.

A drain 96 extends through the bottom side 80 of the outer wall 22 of the housing 12. Continuing, the drain 96 is positioned proximate a center 98 of the bottom side 80 of the outer wall 22 of the housing 12. The drain 96 is fluidly coupled to a plumbing system 11. Lastly, the drain 96 allows the contaminated ice 56 to melt and drain from the lower portion 52 of the housing 12. It shall be noted that the assembly 10 is configured to be positioned underneath a faucet 200 in order for hot water to be introduced in order to melt contaminated ice 16. Moreover, a bus pan 300 is configured to be positioned underneath the assembly 10.

In use, the clean ice 54 is poured into the upper portion 50 of the housing 12 while the panel 44 is in the stored position. If the ice 16 becomes contaminated, the panel 44 is moved into the extended position so the contaminated ice 56 drops into the lower portion 52 of the housing 12. Continuing, the panel 44 is moved into the stored position and the upper portion 50 of the housing 12 is filled with clean ice 54.

With respect to the above description, it is to be realized that the optimum dimensional relationship for the various components of the assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A multi-level storage assembly for storing clean ice discretely from contaminated ice comprising:

a housing configured to contain ice;

a panel movably coupled to said housing wherein said panel defines an upper portion and a lower portion of an interior of said housing, said upper portion storing the clean ice, said lower portion storing the contaminated ice;

a drain coupled to said housing;

wherein a track coupled to an inside surface of an outer wall of said housing proximate a center of said outer wall of said housing;

wherein said track extending between a front side and a rear side of said outer wall of said housing;

wherein said track being one of a pair of said tracks;

wherein a second one of said tracks being coupled to a second lateral side of said outer wall of said housing;

wherein a first lateral edge and a second lateral edge of said panel engaging an associated one of a first and a second track wherein said panel is slidably coupled to said housing;

wherein said panel being positionable in a stored position wherein a rear edge of said panel abuts an inside surface of a rear side of an outer wall of said housing wherein said panel is configured to support the ice in said upper portion of said housing;

wherein said panel being positionable in an extended position wherein a rear edge of said panel is spaced apart from an inside surface of a rear side of an outer wall of said housing wherein said panel is configured to release the ice into said lower portion of said housing;

wherein a leg coupled to and extending downwardly from a bottom side of an outer wall of said housing wherein said leg is configured to support said housing above the support surface;

wherein said leg being one of a plurality of said legs;

wherein each of said plurality of legs being positioned proximate an associated one of four corners of said bottom side of said outer wall of said housing;

wherein a bottle holder is coupled to the panel; wherein the bottle holder is a fixture to the top side of the panel;

wherein the bottle holder is affixed to the front edge of the panel; wherein the bottle holder has a front edge that corresponds with the front edge of the panel;

wherein the bottle holder is further defined with a depth between 10 cm and 15 cm.

2. The assembly according to claim 1 wherein said housing having an open top side to access said interior of said housing.

3. The assembly according to claim 1 wherein a first one of said tracks being coupled to a first lateral side of said outer wall of said housing.

4. The assembly according to claim 1 wherein the bottle holder extends between the first lateral side and the second lateral side of the outer wall of the housing; wherein the bottle holder is open from above such that a plurality of bottles are adapted to be inserted therein for storage purposes and removed as needed.

5. The assembly according to claim 4 wherein said drain extending through a bottom side of an outer wall of said housing wherein said drain is positioned proximate a rear of said bottom side of said outer wall of said housing.

6. A multi-level storage assembly for storing clean ice discretely from contaminated ice comprising:

a housing configured to contain ice;

a panel movably coupled to said housing wherein said panel defines an upper portion and a lower portion of an interior of said housing, said upper portion storing the clean ice, said lower portion storing the contaminated ice; and a drain coupled to said housing;

wherein said housing having an open top side to access said interior of said housing;

wherein a track coupled to an inside surface of an outer wall of said housing proximate a center of said outer wall of said housing;

wherein said track extending between a front side and a rear side of said outer wall of said housing;

wherein said track being one of a pair of said tracks; wherein a first one of said tracks being coupled to a first lateral side of said outer wall of said housing; wherein a second one of said tracks being coupled to a second lateral side of said outer wall of said housing; wherein a first lateral edge and a second lateral edge of said panel engaging an associated one of a first and a second track wherein said panel is slidably coupled to said housing; wherein said panel being positionable in a stored position wherein a rear edge of said panel abuts an inside surface of a rear side of an outer wall of said housing wherein said panel is configured to support the ice in said upper portion of said housing; wherein said panel being positionable in an extended position wherein a rear edge of said panel is spaced apart from an inside surface of a rear side of an outer wall of said housing wherein said panel is configured to release the ice into said lower portion of said housing; wherein a leg coupled to and extending downwardly from a bottom side of an outer wall of said housing wherein said leg is configured to support said housing above the support surface; wherein said leg being one of a plurality of said legs; wherein each of said plurality of legs being positioned proximate an associated one of four corners of said bottom side of said outer wall of said housing; wherein a bottle holder is coupled to the panel; wherein the bottle holder is a fixture to the top side of the panel; wherein the bottle holder is affixed to the front edge of the panel; wherein the bottle holder has a front edge that corresponds with the front edge of the panel; wherein the bottle holder is further defined with a depth between 10 cm and 15 cm; wherein the bottle holder extends between the first lateral side and the second lateral side of the outer wall of the housing; wherein the bottle holder is open from above such that a plurality of bottles are adapted to be inserted therein for storage purposes and removed as needed; wherein said drain extending through a bottom side of an outer wall of said housing wherein said drain is positioned proximate a rear of said bottom side of said outer wall of said housing.

* * * * *